United States Patent [19]

Compen et al.

[11] Patent Number: 4,551,652

[45] Date of Patent: Nov. 5, 1985

[54] DISPLAY SCREEN HAVING ALUMINUM PHOSPHATE BARRIER LAYER AND METHOD OF MANUFACTURE

[75] Inventors: Johannes M. A. A. Compen; Cornelis Maan, both of Eindhoven, Netherlands

[73] Assignee: U.S. Philips Corporation, New York, N.Y.

[21] Appl. No.: 383,844

[22] Filed: Jun. 1, 1982

[30] Foreign Application Priority Data

Jun. 3, 1981 [NL] Netherlands ..... 8102689

[51] Int. Cl.[4] ..... H01J 29/28; H01J 29/10; B05D 5/06

[52] U.S. Cl. ..... 313/466; 313/473; 427/68

[58] Field of Search ..... 313/466, 473; 427/68

[56] References Cited

U.S. PATENT DOCUMENTS

| | | | |
|---|---|---|---|
| 3,703,401 | 11/1972 | Deal et al. | 427/68 |
| 3,911,165 | 10/1975 | Kanai et al. | 313/466 X |
| 4,025,661 | 5/1977 | Moscony et al. | 427/68 |
| 4,407,916 | 10/1983 | Akagi et al. | 430/23 |

*Primary Examiner*—Palmer C. DeMeo
*Assistant Examiner*—Sandra H. O'Shea
*Attorney, Agent, or Firm*—Robert J. Kraus

[57] ABSTRACT

Corrosion of an aluminium film on the display screen of a display tube as a result of an electro-chemical reaction between water and aluminium is substantially prevented by providing the aluminium with an aluminium phosphate layer at the area where it adjoins the carbon particles. This may be done by rinsing or spraying the carbon particles with an at most 2% by weight phosphoric acid solution in water prior to or after providing the aluminium film.

7 Claims, 4 Drawing Figures

DISPLAY SCREEN HAVING ALUMINUM PHOSPHATE BARRIER LAYER AND METHOD OF MANUFACTURE

BACKGROUND OF THE INVENTION

The invention relates to a display tube comprising an evacuated envelope having a display window and containing means to generate at least one electron beam which is deflected over a display screen provided on the inside of the display window. The display screen comprises a luminescent layer on which a thin electron-permeable aluminium film is provided. The display screen also includes carbon particles.

The invention also relates to methods of manufacturing a display screen for such a display tube.

The aluminium film in such a display tube effects an increase in the brightness of the picture. The film operates as a mirror which reflects a part of the light generated in the luminescent layer through the display window in the direction of the viewer.

Such display tubes may be tubes for monochromatic display of pictures, for example black-and-white television display tubes, projection television display tubes, cathode ray tubes as used in oscilloscopes and tubes for displaying letters, digits and characters (so-called D.G.D. tubes, where D.G.D. represents Data Graphic Display).

The luminescent layer in D.G.D. tubes often consists of material luminescing in one colour. However, such tubes may also be tubes for displaying coloured pictures. In case that the luminescent layer of the display screen often consists of a large number of triplets of elements luminescing in three different colours, sometimes separated by lightabsorbing material. By using a colour selection electrode in the tube, each of the three electron beams generated in the tube is associated with luminescent elements of a respective colour. The most frequently used colour selection electrode is the shadow mask.

Such a display tube is known from Netherlands Patent Application No. 6800398 laid open to public inspection corresponding to British Pat. No. 1,152,290 in which a colour display tube having post-acceleration and post-focusing is described. A porous carbon layer is provided on the thin aluminium film to absorb the greater part of the secondary and reflected electrons which occur in such a post-acceleration tube. Netherlands Patent Application No. 6,916,046, corresponding to British Pat. No. 1,260,079 discloses a colour display tube in which a layer of graphite (carbon) is used on the aluminium film to absorb the thermal radiation originating from the colour selection electrode. The electron beams in a colour tube impinge on the colour selection electrode or the display screen and produce thermal energy. Inter alia because more electrons impinge on the colour selection electrode, it becomes warmer than the screen. In order to prevent the thermal energy radiated from the colour selection electrode to the display screen from being reflected by the aluminium film to the colour selection electrode, the aluminium film bears a heat-absorbing carbon layer.

In the manufacture of display tubes it has been found that the aluminium film on which a porous heatabsorbing and/or secondary and reflected electronsabsorbing porous layer of carbon particles was provided, corroded in a moist atmosphere. The corrosion of the aluminium occurs at particular in those places where the aluminium film is in contact with the carbon particles where an electrochemical reaction occurs between water and aluminium. The most important factor is the relative humidity of the atmosphere. At a relative humidity of 80% or higher the corrosion of the aluminium film is so large that measures have to be taken to protect the aluminium film.

Such corrosion of the aluminium film also occurs in colour display tubes in which light absorbing material consisting mainly of carbon particles was provided between the luminescent elements.

SUMMARY OF THE INVENTION

It is therefore an object of the invention to provide a display tube in which measures are taken to substantially prevent corrosion of the aluminium film.

Another object of the invention is to provide methods of manufacturing such a display tube. According to the invention, a display tube of the kind described in the opening paragraph is characterized in that the aluminium film is covered with aluminium phosphate at least at the area where it adjoins the carbon particles. The aluminium phosphate coating ensures that substantially no corrosion of the aluminium film occurs.

A first preferred embodiment of a display tube according to the invention is characterized in that a porous, electron-permeable layer comprising carbon particles is provided on the aluminium film and the aluminium film is covered at least partly with aluminium phosphate on the side of the porous carbon particles-containing layer, at least at the area where the carbon particles adjoin the aluminium. Such a porous carbon particles containing layer is black for thermal radiation. This means that the screen readily absorbs thermal energy but also readily radiates thermal energy. By providing such a thermally black layer on the aluminium film of the display screen, the thermal energy generated by the electron beam in the luminescent material is rapidly dissipated by radiation so that the display screen can be loaded more heavily (a larger beam current is allowable) and a brighter picture can be obtained. This is of importance in particular in projection television display tubes.

Such a porous layer may also be used for thermal absorption in a colour display tube which is characterized in that the luminescent layer of the display screen comprises a large number of triplets of elements luminescing in three different colours, in front of which display screen a colour selection electrode is provided which associates each of the three electron beams generated in the tube with luminescent elements of a respective colour. Such as colour display tube is disclosed in the already mentioned Netherlands Patent Application No. 6916046 laid open to public inspection.

In order to obtain the aluminium phosphate coating of the aluminium film it is possible to spray or rinse the film with a phosphoric acid solution prior to providing the porous carbon layer.

A preferred method of manufacturing a display screen for a display tube in accordance with the invention is characterized in that the method comprises the following steps:

providing a luminescent layer vapour-depositing an aluminium film over the luminescent layer providing a porous carbon particles-containing layer spraying or rinsing the porous carbon particlescontaining layer with an at most 2% by weight phorphoric acid solution in water drying the display screen.

British Patent Specification No. 810,110 discloses a colour display tube in which between the luminescent elements of the display screen carbon (graphite) is provided for absorbing light which impinges on the display screen from outside, to increase the contrast of the colour display screen. Such a colour display tube is also termed a matrix colour display tube. Again an aluminium film is provided over the luminescent elements and the carbon. In order to prevent corrosion of the aluminium film at the area where it is in contact with the carbon particles, according to the invention the aluminium film is covered with aluminium phosphate at least at the area where it adjoins the light-absorbing material (carbon).

A preferred method of manufacturing such a display screen is characterized in that the method comprises the following steps:

providing a pattern of triplets of luminescent elements providing light-absorbing material consisting mainly of carbon particles between the luminescent elements spraying or rinsing the material and the luminescent elements with an at most 2% by weight phosphoric acid solution in water drying the provided material and the luminescent elements vapour-depositing the aluminium film.

As is known, the first two steps of this process may be intercharged. In this method the phosphoric acid is adsorbed on the carbon. After drying the screen and vapour-depositing the aluminium film the phosphoric acid reacts with the aluminium and forms aluminium phosphate. During the further finishing of the tube the phosphate layer has corrosion-inhibiting properties. It is also possible to use the two above mentioned methods which have been modified by using a phosphoric acid solution which also contains 0.1 to 2.0% by weight of aluminium phosphate ($AlPO_4$). Since phosphates, like for example, silicates, can polymerize, the aluminium phosphate solution forms a binder with very good adhesion properties. Experiments have demonstrated that the concentration of $AlPO_4$ in $H_3PO_4$ determines in part the properties of the binder formed. This concentration may be expressed in the mole ratio $P_2O_5/Al_2O_3$ which preferably is between 2 and 4. After drying the aluminium phosphate remains in the carbon layer so that the latter adheres even better. This reduces the occurrence of undesired loose carbon particles in the display screen. Moreover it has been found that upon using the abovementioned first method combustion of the carbon particles during sealing of the display window to the remainder of the envelope is considerably reduced. During this sealing process, approximately 40% of the carbon particles burns without the use of the method. When using the method in which the porous layer comprising carbon particles is sprayed with a phosphoric acid solution or with a phosphoric acid solution in which aluminium phosphate has been dissolved in the phosphoric acid, this is reduced to 20%. As a result of this it is possible to obtain a more constant blacking quality of the porous layer.

BRIEF DESCRIPTION OF THE DRAWING

The invention will now be described in greater detail, by way of example, with reference to a drawing, in which.

DESCRIPTION OF THE PREFERRED EMBODIMENTS

Figure 1:
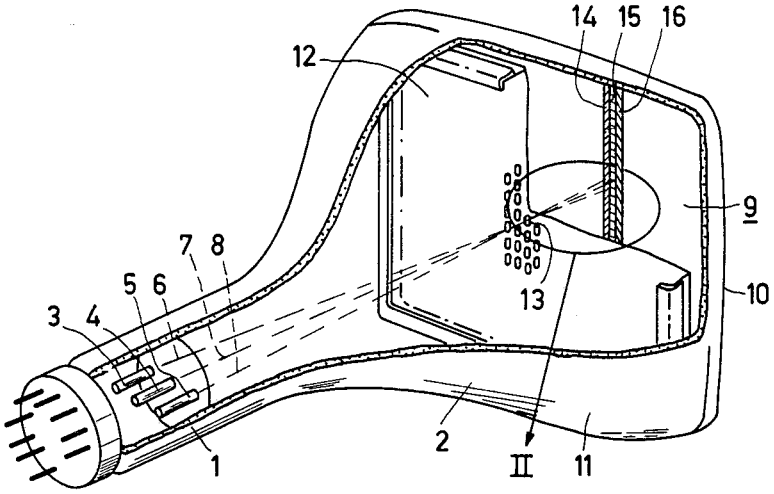
FIG. 1 is a broken-away elevation of a colourdisplay tube according to the invention.

FIG. 1 is a broken-away elevation of a colourdisplay tube according to the invention. Present in a neck 1 of a glass envelope 2 are three electron guns 3, 4 and 5 for generating three electron beams 6, 7 and 8 which are focused on a display screen 9 on the inside of a display window 10 which is sealed to a display tube cone 11. The beams are deflected over the display screen in two mutually perpendicular directions. The three electron beams 6, 7 and 8, which enclose a small angle with each other, pass through a colour selection electrode 12 via apertures 13 and then impinge on luminescent elements 14, 15 and 16, respectively, each made of a phosphor luminescing in a different colour. The display screen consists of a very large number of triplets of phosphor lines of which only three are shown.

Figure 2:
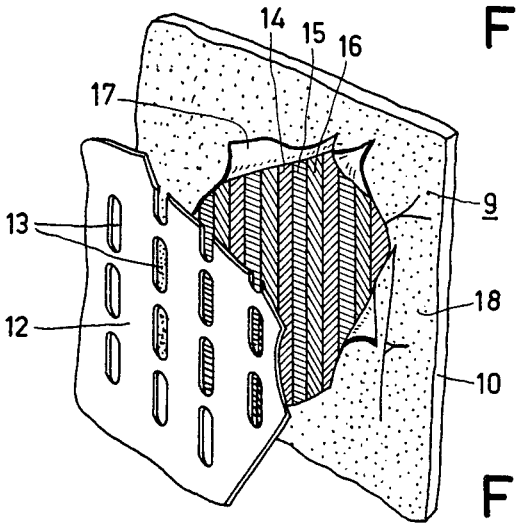
FIG. 2 is an elevation of a part of the colour selection electrode and of the display window with the display screen present thereon.

FIG. 2 is an elevation of a part of the colour selection electrode and of the display window 10 with the display screen 9 provided thereon. An aluminium film 17 on which a porous layer 18 of carbon is provided, is disposed on the triplets of phosphor lines.

Figure 3:
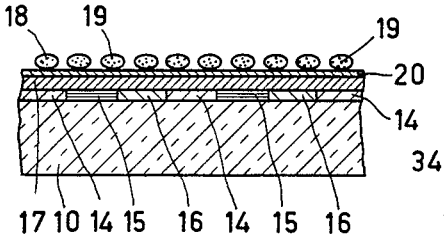
FIG. 3 is a sectional view on an enlarged scale of a fragment of the display window with the display screen present thereon.

FIG. 3 is a sectional view of a fragment of the display window with the display screen provided thereon. The luminescent elements 14, 15 and 16 are provided in the usual manner on the glass of the display window 10. Over the elements, which usually consist of a phosphor, a 0.3$\mu$m thick aluminium film is vapour deposited. On this film a porous layer 18 consisting of carbon particles 19 is provided at an average thickness of 0.3$\mu$m and at a weight of 0.1 to 0.2 mg/cm$^2$. By rinsing or spraying the aluminium film 17 coated with the porous layer 18 of carbon with the phosphoric acid solution described, a corrosion reducing layer 20 of aluminium phosphate is formed at the surface of the aluminium film. This layer has an average thickness of 0.5$\mu$m. If in addition aluminium phosphate is also dissolved in the phosphoric acid solution, aluminium phosphates also deposit between the grains 19 of the porous carbon layer 18 as a result of which the adhesion of the grains 19 becomes even better.

Figure 4:
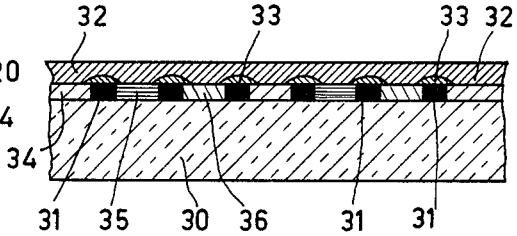
FIG. 4 is a sectional view of a fragment of the display window with the display screen present thereon of a colour display tube according to the invention of the matrix type.

FIG. 4 is a sectional view analogous to FIG. 3 but now of a colour display tube of the matrix type. In the usual manner, for example via a photographic or electrophotographic process, the luminescent elements 34, 35 and 36 are provided on the glass of the display window 30 between which elements light-absorbing elements 31 of carbon are provided. A O.2$\mu$m thick aluminium film 32 is vapour-deposited over the luminescent elements and the light-absorbing carbon on which, just as in the display screen shown in FIG. 3, a porous carbon layer may again be provided (not shown in this Figure). By rinsing or spraying the luminescent elements and the light-absorbing carbon therebetween prior to vapour depositing the aluminium film, phosphoric acid is adsorbed on the carbon. After vapour deposition of the aluminium film, the phosphoric acid reacts with the aluminium and aluminium phosphate 33 is formed. This aluminium phosphate has an amorphous structure, is a good electrical insulator and gives corrosioninhibiting properties to the aluminium film so that substantially no corrosion occurs at a large relative humidity (95%) for a very long time (2 to 3 weeks).

What is claimed is:

1. In a display tube comprising an envelope including a display window, a display screen disposed on an inner surface of said display window, and means for directing an electron beam at said screen, said display screen comprising at least one layer of a luminescent material deposited on said display window, at least one layer of a particulate carbon-containing material, and an electron permeable layer of an aluminum containing material deposited on said luminescent material, the improvement comprising a layer of aluminum phosphate disposed between said carbon-containing material and said aluminum containing material.

2. A display tube as in claim 1 where the particulate carbon-containing material is deposited on a surface of the electron permeable layer remote from the display window.

3. A display tube as in claim 2 comprising a projection television display tube.

4. A display tube as in claim 1 where the display screen comprises a plurality of spaced-apart parallel stripes of the luminescent material, and a particulate carbon-containing material deposited on the display window between said stripes of luminescent material.

5. A method of manufacturing a display screen for a display tube comprising:

(a) depositing a layer of a luminescent material on an inner surface of a display window of said tube;

(b) vapor depositing an electron permeable layer of an aluminum containing material on said luminescent material;

(c) depositing a layer of a particulate carbon-containing material on said electron permeable layer;

(d) soaking said particulate carbon-containing material with a solution consisting essentially of a maximum of 2% by weight of phosphoric acid dissolved in water; and (e) drying the display screen.

6. A method of manufacturing a display screen for a display tube comprising:

(a) depositing a plurality of spaced-apart parallel stripes of luminescent material on an inner surface of a display window of said tube;

(b) depositing a particulate carbon-containing material on the inner surface of said display window between said stripes of luminescent material;

(c) soaking said particulate carbon-containing material with a solution consisting essentially of a maximum of 2% by weight of phosphoric acid dissolved in water;

(d) drying said materials; and (e) vapor depositing an electron permeable layer of an aluminum containing material on said dried materials.

7. A method as in claim 5 or 6 where said solution further includes 0.1 to 2.0% by weight of aluminum phosphate.

* * * * *